United States Patent [19]

Lange et al.

[11] Patent Number: 4,819,026

[45] Date of Patent: Apr. 4, 1989

[54] CLEANING APPARATUS FOR A CHARGE RETENTIVE SURFACE

[75] Inventors: Clark V. Lange, Ontario; Bruce E. Thayer, Webster; John M. Wysocky, Rochester, all of N.Y.

[73] Assignee: Xerox Corporation, Stamford, Conn.

[21] Appl. No.: 135,962

[22] Filed: Dec. 21, 1987

[51] Int. Cl.[4] ..... G03G 15/08

[52] U.S. Cl. ..... 355/15; 355/3 DD; 355/14 D; 15/256.51; 118/652

[58] Field of Search ..... 355/15, 3 DD, 14 D; 15/256.51, 256.52; 118/652; 430/42, 45, 125

[56] References Cited

U.S. PATENT DOCUMENTS

| | | | |
|---|---|---|---|
| 3,572,923 | 3/1971 | Fisher et al. | 355/15 |
| 3,580,673 | 5/1971 | Yang | 355/15 |
| 3,655,373 | 4/1972 | Fisher et al. | 96/1.4 |
| 3,722,018 | 3/1973 | Fisher | 15/1.5 |
| 3,780,391 | 12/1973 | Leenhouts | 15/1.5 |
| 4,054,381 | 10/1977 | Bernhard | 355/15 |
| 4,083,633 | 4/1978 | Shanly | 355/15 |
| 4,116,555 | 9/1978 | Young et al. | 355/15 |
| 4,436,411 | 3/1984 | Miyoshi et al. | 355/14 D |
| 4,447,929 | 5/1984 | Hennig et al. | 15/256.5 |
| 4,494,863 | 1/1985 | Laing | 355/15 |
| 4,571,071 | 2/1986 | Bothner | 355/15 |
| 4,639,124 | 1/1987 | Nye, Jr. et al. | 355/15 |

FOREIGN PATENT DOCUMENTS

| | | |
|---|---|---|
| 0036290 | 5/1984 | European Pat. Off. . |
| 57-198485 | 12/1982 | Japan . |

*Primary Examiner*—A. C. Prescott

*Attorney, Agent, or Firm*—Mark Costello

[57] ABSTRACT

Toner removal device for removing residual toner and debris from a charge retentive surface after transfer of toner images from the surface. This device is characterized by the use of a pair of electrically biased detoning rolls, one for removing toner from a biased cleaner brush for recirculation and use and the other for removing debris such as paper fibers and Kaolin from the brush. Placement of the detoning rolls is selected so that the brushes are located adjacent natural oscillation nodes of the brush, and closely spaced to the position where the cleaning brush leaves contact with the charge retentive surface. Cleaning blades for the detoning rolls are integrally provided with holders for insertion into receiving slots in the cleaning housing. Extrusion sleeves are provided for insertion into toner transport devices for removal for cleaning.

14 Claims, 2 Drawing Sheets

CLEANING APPARATUS FOR A CHARGE RETENTIVE SURFACE

Figure 1:
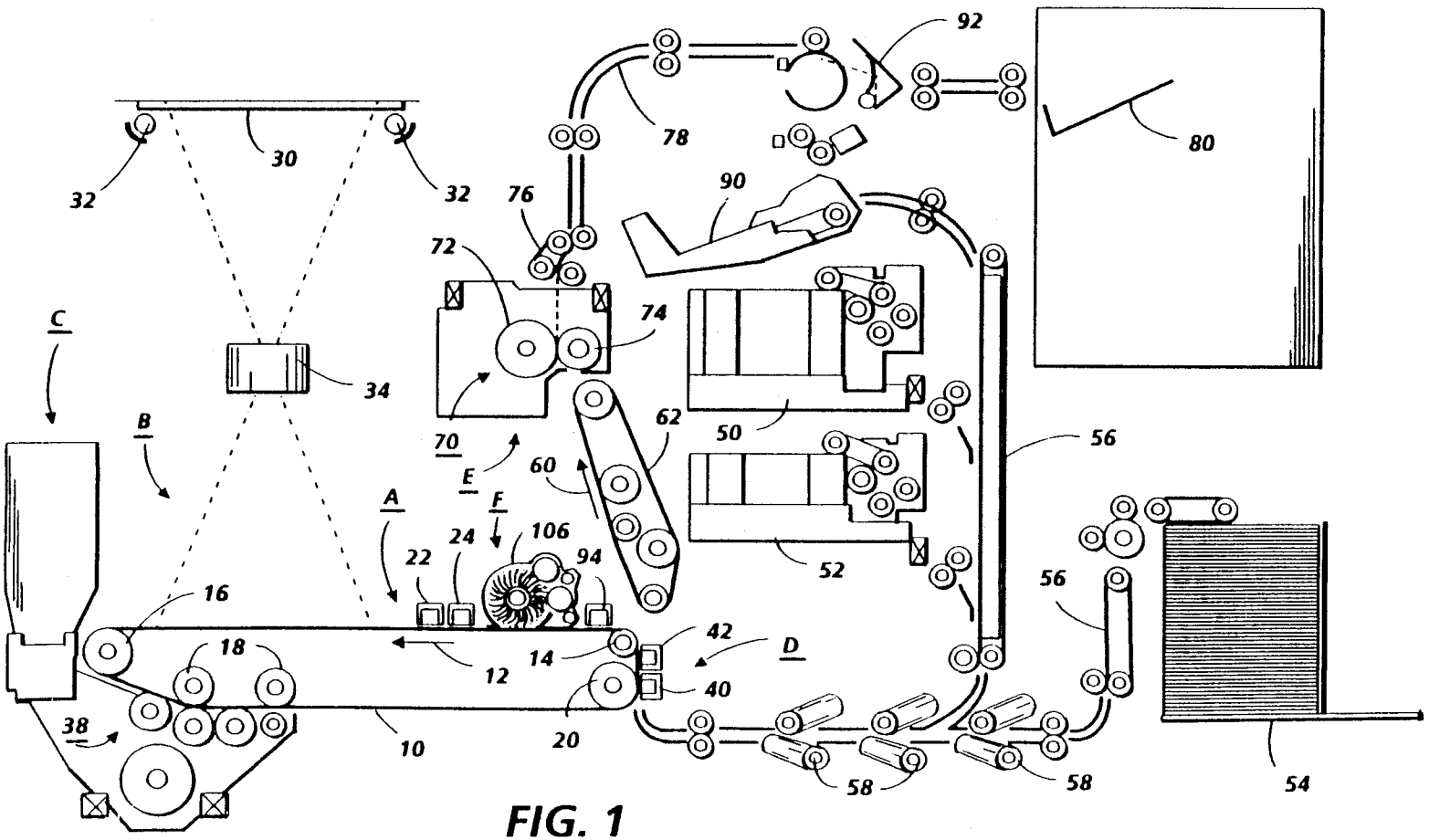

This invention relates to reproduction apparatus and more particularly to cleaning apparatus for removing residual toner and debris such as paper fibers and Kaolin from a charge retentive surface forming a part of the reproduction apparatus, with subsequent electrostatic separation of toner from the debris.

INCORPORATION BY REFERENCE

The following are herein incorporated by reference for the purpose of background information: EP No. 036290-B1, U.S. Pat. No. 4,494,863 to Laing; U.S. Pat. No. 4,639,124 to Nye; U.S. Pat. No. 3,572,923 to Fisher; U.S. Pat. No. 3,655,373 to Fisher et al; U.S. Pat. No. 3,780,391 to Leenhouts; U.S. Pat. No. 3,580,673 to Yang; U.S. Pat. No. 3,722,018 to Fisher; and U.S. Pat. No. 4,116,555 to Young et al.

BACKGROUND OF THE INVENTION

In electrophotographic applications such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned form the surface. The process is well known, and useful for light lens copying from an original, and printing applications from electronically generated or stored originals, where a charged surface may be imagewise discharged in a variety of ways.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed in automatic xerography utilizes a brush with soft fiber bristles which have suitable triboelectric characteristics. While the bristles are soft they are sufficiently firm to remove residual toner particles from the charge retentive surface. In addition, webs or belts of soft fibrous or tacky materials and other cleaning systems are known.

More recent developments in the area of removing residual toner and debris from a charge retentive surface have resulted in cleaning structures which, in addition to relying on the physical contacting of the surface to be acted upon also rely on electrostatic fields established by electrically biasing one or more members in a cleaning system.

It has been found that establishing an electrostatic field between the charge retentive surface and the cleaning member such as a fiber brush or a magnetic brush enhances toner attraction to the cleaning brush surface. A biased detoning device may be used to remove toner from the cleaning member. Such arrangements are disclosed in U.S. Pat. No. 3,572,923 to Fisher, U.S. Pat. No. 3,655,373 to Fisher et al. U.S. Pat. Nos. 3,780,391 to Leenhouts, 3,580,673 to Yang and 3,722,018 to Fisher. The creation of the electrostatic field between the brush and photoreceptor is accomplished by applying a D.C. voltage to the brush. When the fibers or granules forming the brush are electrically conductive and a bias is applied thereto, cleaning is observed to be more efficient than if the fibers or granules are non-conductive or insulative.

EP No. 036290-B1 discloses a magnetic brush and insulative detoning roll both of which have electrical biases applied thereto for establishing the desired electrostatic fields between the brush and the photoreceptor and between the brush and the detoning roll. The field established between the conductive brush and the insulative photoreceptor is such that the toner on the photoreceptor is attracted to the brush. Thus, if the toner on the photoreceptor is positively charged, then the aforementioned field would be negative. In order to attract the toner from the brush onto the detoning roll, the detoning roll is electrically biased to a greater negative potential than the brush.

U.S. Pat. No. 4,494,863 to Laing discloses a toner removal device for removing residual toner and debris from a charge retentive surface after transfer of toner images from the surface. This device is characterized by the use of a pair of detoning rolls, one for removing toner from a biased cleaner brush and the other for removing debris such as paper fibers, Kaolin, etc., from the brush. The rolls are electrically biased so that one of them attracts toner from the brush while the other one attracts debris. Thus, the toner can be reused without degradation of copy quality while the debris can be discarded. U.S. Pat. No. 4,639,124 to Nye shows a similar arrangement separating colored toners collected from a magnetic brush. U.S. Pat. No. 4,116,555 to Young et al. similarly discloses a toner removal device characterized by the use of a pair of detoning rolls, one for removing toner from a biased magnetic cleaner brush and the other for removing wrong sign toner.

A blade cleaning arrangement for removal of toner from the detoning rolls is used in the Xerox 1075 and 1090 copiers. These products use 0.002 inch thick Starret steel shim stock as a scraper blade held in a channel with a plastic spring clip. When the blade requires replacement due to wear, the blade and auger channel assembly must be removed for the cleaner, the spring clip removed, the blade removed, the new blade inserted, the spring clip reinstalled and the assembly reinstalled in the cleaner. This is a time consuming operation, and difficult to perform. U.S. Pat. No. 4,083,633 to Shanly and U.S. Pat. No. 4,447,929 to Hennig et al show blade holders where the blade is held in position by its own resiliency and frictional engagement with the walls of the blade holder.

In the Xerox 1075 and 1090 copiers, the blade holder assembly contain the support structures of the auger tubes. The supports are in the form of aluminum extrusions that slide into recesses provided in the cleaner housing. These assemblies, including the auger tubes are removable for cleaning if required. If the cleaner was provided in a single extruded housing, desirable for cost and assembly benefits, it is possible that toner could collect between the auger tube, the holder around the auger and the cleaner extrusion. JP No. 57-198485 to Hida shows a cleaning device removable form a copying machine including a vessel in which accumulating toner collects and a seal which causes accumulating toner to drop into the vessel. U.S. Pat. No. 4,436,411 to Miyoshi et al shows a developing device in which a toner particle dispenser with a reciprocating slide plate to break up agglomerated masses moving along the side walls of the toner particle dispenser to prevent clogging.

SUMMARY OF THE INVENTION

In accordance with the invention there is provided an improved cleaning device for removal of toner and debris from a charge retentive surface or photoreceptor surface.

In accordance with one aspect of the invention, an electrically biased fiber brush cleaning device is arranged adjacent to a photoreceptor surface at a twelve o'clock position for removing residual toner and debris deposited thereon during the operation of the machine. A pair of electrically biased detoning rolls are arranged at approximately the two and four o'clock positions around the circumference of the cleaning brush for removal of toner and debris collected by the brush. The exact position of the first detoning roll is selected as close as possible to a first oscillation node of the fibers, the oscillation of the fibers being caused by leaving brushing contact with the photoreceptor. Positioning the detoning roll adjacent to the oscillation node enhances removal of toner from the brush, since the toner removal process takes advantage of the energy of oscillation in the movement of the fibers which tends to expel air, toner and debris therefrom.

In accordance with another aspect of the invention, positioning the detoning rolls around the fiber brush and closely adjacent to the photoreceptor enhances removal of toner and debris from the fiber brush. Detoning rolls are biased for removal of toner and debris having a particular charge level associated therewith. As toner is moved by the fiber brush bristles, a poorly understood triboelectric charge transfer takes place between the brush bristles and the toner and debris. Over time, the triboelectric charge transfer varies the charge on the toner and debris beyond the charge level considered optimum for removal by biased detoning rolls. Accordingly, minimizing triboelectric charge transfer, by minimization of the time that toner and debris are subject to the triboelectric effect of the brush fibers, allows the toner to be subject to removal from the brush fibers before the triboelectric effect has varied the charge on the toner and debris beyond the optimum level for removal by the biased detoning rolls.

In accordance with another aspect of the invention, placement of the detoning rolls on a common side of the fiber cleaning brush allows the detoning rolls and associated support and collection apparatus to be substantially identical, allowing significant economic manufacturing advantage. In this regard, and in comparison to other collection structures, the present detoning rolls are each provided with an identical blade cleaning structure for removal of collected toner and debris from the rolls, the blade cleaning device including an integral blade and holder slidingly engageable into with a mounting position in the cleaning device housing.

In accordance with yet another aspect of the present invention, an advantageous arrangement for the support of the described cleaning device is in a unitary extrusion, in which recesses are provided for support of the detoning roll assemblies, including the associated support of detoning roll cleaning blades, augers for the removal of toner from the area about the blades, and auger extrusion liners, which allow cleaning of the auger tubes in which the augers are supported.

Figure 2:
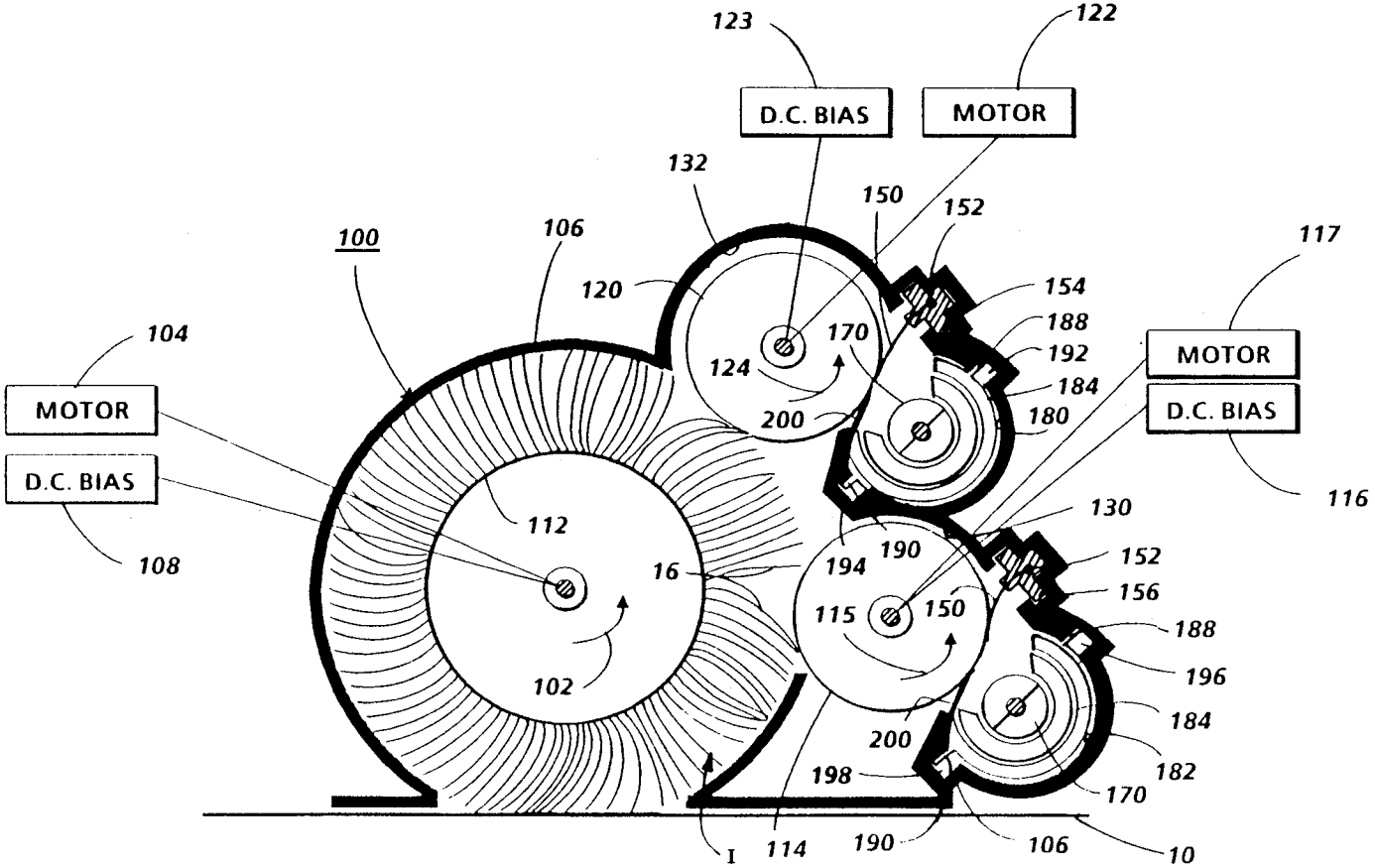

These and other aspects of the invention will become apparent from the following description used to illustrate a preferred embodiment of the invention read in conjunction with the accompanying drawings in which:

FIG. 1 is a schematic elevational view depicting an electrophotographic printing machine incorporating the present invention; and FIG. 2 is a schematic illustration of a cleaner incorporated in the machine of FIG. 1.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original.

A reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 16.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the developed latent image to transfer station D. At transfer station D, a sheet of support material such as a paper copy sheet is moved into contact with the developed latent images on belt 10. First, the latent image on belt 10 is exposed to a pre-transfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detach the copy sheet for belt 10, whereupon the sheet is stripped from belt 10 at stripping roller 14.

Sheets of support material are advanced to transfer station D from supply trays 50,52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc. and removal from the machine by the operator. Alternatively, the sheet may be advanced to a duplex tray 90 from duplex gate 92 from which it will be returned to the processor and conveyor 56 for receiving second side copy.

A pre-clean corona generating device 94 is provided for exposing the residual toner and contaminants (hereinafter, collectively referred to as toner) to positive charges to thereby narrow the charge distribution thereon for more effective removal at cleaning station F, more completely described hereinafter. It is contemplated that residual toner remaining on photoreceptor belt 10 after transfer will be reclaimed and returned to the developer station C by any of several well known reclaim arrangements, and in accordance with the present invention, described below.

As thus described, a reproduction machine in accordance with the present invention may be any of several well known devices. Variations may be expected in specific processing, paper handling and control arrangements without affecting the present invention.

In accordance with the invention, and with reference to FIG. 2, cleaning station F includes a fiber brush cleaning arrangement having dual detoning rolls is provided for the removal of residual toner and debris from belt 10. A captive fiber cleaning brush 100 is supported for rotational movement in the direction of the arrow 102 via motor 104, within a cleaning housing 106, and negatively biased by means of a D.C. power source 108. As described in U.S. Pat. No. 3,572,923 to Fisher et al, a fiber brush may advantageously comprise a large number of conductive cleaning fibers 110 supported on a cylindrical conductive member 112. In a preferred embodiment, housing 106 may be economically manufactured in a unitary extrusion, with recesses formed in accordance with component requirements. Residual toner and contaminants or debris such as paper fibers and Kaolin are removed from the photoreceptor belt 10 surface by means of a brushing action of the fibers 110 against belt 10 and the electrostatic charge applied to the fibers from by the D.C. power supply 108. In a xerographic system of the type disclosed herein, brush 100 will remove both toner and debris from the photoreceptor, the former having a positive and the latter having a negative charge. Negatively charged contaminants are removed along with the positively charged toner particles to which they may be adhered. In accordance with the invention, brush fibers 110 bearing toner and debris removed from belt 10 are first contacted by a first detoning roll 114 supported for rotation in the direction of arrow 115, the same direction as brush 100 by means of a motor 116. An electrical bias is supplied to first detoning roll 114 from D.C. power supply 117. In accordance with the invention, detoning roll 114 is supported in operational position against brush 100, closely spaced to the position where brush fibers 110 leave contact with the surface of photoreceptor belt 10. The position of detoning roll 114 is selected so that the brush fibers 110 are contacted by the detoning roll closely adjacent to the first oscillation node I after contact with the photoreceptor is ended. That is, after the fibers leave contact with the photoreceptor, there is a tendency for the fibers to oscillate in a partially damped fashion. This oscillatory motion causes air and toner to be ejected from the brush at nodal locations where the fibers are bunched together, as demonstrated in the drawing. Placement of the first detoning roll closely spaced to this position allows collection of ejected matter. It is particularly notable that this ejected toner and debris is relatively low in charge, and is likely to be wrong sign toner, desirably removed from toner which will be recirculated to the developer housing, as well lightly charged paper fibers or Kaolin (hereinafter, collectively referred to as "debris"). The oscillation node positions vary around the circumference of the brush in accordance with the speed of the cleaning brush. It is additionally desirable that this position also be located closely adjacent to the photoreceptor, so that a minimum amount of time is allowed for charge triboelectric charge exchange between the toner and debris and the brush fibers. In this manner, the bias level on the detoning rolls may be selected to obtain optimum attraction of debris.

A second detoning roll 120 is provided for further removal of the preponderance of residual toner from the brush at a location spaced along the circumference of the brush. A motor 122 drives the roll in the detection of the arrow 124, the same direction as fiber brush 100 and roll 114. An electrical bias is supplied to the roll 120 from a source of D.C. power 123. In a working embodiment of the described cleaning arrangement, the cleaning brush is biased to a potential of about −250 V, while the first detoning roll is biased to about −50V and the second detoning roll is biased to about −650 V. Thus, only the lightly charged debris and wrong sign toner will be removed from the brush at the first detoning roll, while the preponderance of toner will be removed from the second roll for recirculation. In an operational embodiment, the first and second detoning rolls were located at approximately four o'clock and two o'clock positions around a cleaning brush situated at 12 o'clock with respect to photoreceptor belt 10. Of course the positions of the detoning rolls may vary in accordance with the speed of the cleaning brush.

Recesses 130 and 132 in cleaning housing 106 are provided for the support of the detoning rolls 114 and 120 respectively therein. Within these recesses, and removed from cleaning brush 100, are located blade and auger arrangements for the chiseling removal of toner from the detoning rolls and movement of the toner to a storage area or to the developing station. It is an advantage of the described invention, that by arranging the detoning rolls on a single side of the cleaning brush 100, preferably the "uphill" side between the 12 o'clock and 5 o'clock positions on the cleaner brush, the detoning roll, blade and auger arrangements may be substantially identical. Accordingly, each detoning roll is provided with an associated cleaning blade 150 supported in chiseling contact with each detoning roll in a molded blade holder 152, which is slidably insertable into integrally formed, complementary blade holder recesses 154 and 156 in housing 106. The integral arrangement of blade 150 and blade holder 152 allows for simple removal from blade holder recesses 154 and 156, and replacement without concern for replacement of spring loaded mounting apparatus.

Debris and toner from detoning rolls 114 and 120 are removed from the cleaning housing by an auger arrangement, which respectively moves debris to a storage area for subsequent removal and toner to the developer station for reuse. Accordingly, augers 170 are supported for rotating movement within auger recesses 180 and 182, formed in the cleaning housing adjacent to recesses 130 and 132 for the detoning rolls. The augers are supported within the cleaning housing within liners 184 formed in plastic to fit into the auger recesses, and which are slidably removable from the tubes for cleaning and service. Liners 184, are advantageously provided with a pair of wings 188 and 190 which are seated in slots 192, 194, 196 and 198 integrally formed in the auger recesses of the cleaning housing. To prevent toner and debris from entering any space between the plastic liner and the auger recess, a film seal member 200 is provided on liners 184, attached with an adhesive to an exterior surface of liner 184, so that it extends outwardly from between the liners and the auger recess. Film seal member 200 extends towards the blade 150, into contact with the detoning rolls, so that toner or debris chiseled from the detoning roll with the blade is maintained in the area adjacent the blade and auger arrangement, and does not enter the area between the plastic liner and the auger recess. With blade 150, film seal 200 effectively seals the auger arrangement from the remainder of the cleaning station and prevents toner clouds created by the blade and auger from dispersing outside of the auger/blade cavity.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

We claim:

1. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning brush supported for rotation and contact with the charge retentive surface for removing residual toner and debris therefrom, said brush electrically biased to aid in the removal of residual toner and debris from the charge retentive surface;

detoning means supported for contact with said brush, and electrically biased for removal from said brush of residual toner and debris; and said detoning means located adjacent to an oscillation node of said brush caused by release of brush portions from cleaning contact with said charge retentive surface.

2. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning brush supported for rotation and contact with the charge retentive surface for removing residual toner and debris therefrom, said brush electrically biased to aid in the removal of residual toner and debris from the charge retentive surface;

detoning means supported for contact with said brush, and electrically biased for removal from said brush of residual toner and debris; and said detoning means located closely adjacent to the position on the charge retentive surface from where brush portions are released from cleaning contact with said charge retentive surface.

3. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning housing supporting a cleaning brush, generally cylindrical in cross section, for rotation and contact with the charge retentive surface for removing residual toner and debris therefrom at a twelve o'clock position with respect to the charge retentive surface, said brush electrically biased to aid in the removal of residual toner and debris from the charge retentive surface;

first and second detoning means supported for contact with said brush, and electrically biased for removal from said brush of residual debris and toner, respectively; and said first and second detoning means each located adjacent the other, and between one o'clock and five o'clock positions around the brush.

4. The apparatus as defined in claim 3 wherein each said detoning means includes a detoning roll supported for rotation and in contact with said fiber brush, a cleaning blade member for cleaning collected toner or debris from said detoning roll and an auger means for removal of toner cleaned from the detoning roll to an output.

5. The apparatus as defined in claim 4 wherein said cleaning blade member integrally includes a blade portion and a holder portion, said holder portion slidably insertable into a complementary holder recess formed in said cleaning housing and associated with each said detoning means.

6. The apparatus as defined in claim 3 wherein said first detoning means is located adjacent to a first oscillation node of said brush caused by release of the fibers of said fiber brush from cleaning contact with said charge retentive surface.

7. The apparatus as defined in claim 6 wherein each said detoning means includes a detoning roll supported for rotation and in contact with said fiber brush, a cleaning blade member for cleaning collected toner or debris from said detoning roll and an auger means for removal of toner cleaned from the detoning roll to an output.

8. The apparatus as defined in claim 7 wherein said cleaning blade member integrally includes a blade portion and a holder portion, said holder portion slidably insertable into a complementary holder recess formed in said cleaning housing and associated with each said detoning means.

9. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning housing formed in a unitary extrusion and located adjacent to the charge retentive surface;

a fiber brush cylindrical in cross section, supported within a generally conforming brush portion formed in said cleaning housing for rotation and contact with the charge retentive surface for removing residual toner and debris therefrom at a twelve o'clock position, said brush electrically biased to aid in the removal of residual toner and debris from the charge retentive surface;

first and second detoning means supported within detoning area recesses formed in said cleaning housing adjacent said conforming brush portion, for contact with said brush, and electrically biased for removal from said brush of residual debris and toner, respectively, each said detoning means including a detoning roll in contact with said fiber brush, a cleaning blade member for cleaning collected toner or debris from the detoning rolls and an auger means for removal of toner from the detoning means to an output.

10. The apparatus as defined in claim 9 wherein said cleaning blade member integrally includes a blade portion and a holder portion, said holder portion slidably insertable into a complementary holder recesses formed in said cleaning housing within said detoning area recesses.

11. The apparatus as defined in claim 9 wherein said auger means for removal of toner from the detoning means to an output is supported within an auger recess formed in said cleaning housing within said detoning area recess, and includes an auger supported for augering motion for moving toner through said auger recess to an output, and an auger extrusion liner, removably insertable into said auger recess and sealing means, integral with said auger extrusion liner for preventing toner from escaping said auger recess.

12. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning housing formed in a unitary extrusion and located adjacent to the charge retentive surface;

a cleaning blade member integrally including a blade portion and a holder portion, said holder portion slidably and removably insertable into a complementary holder recess formed in said cleaning housing to hold said cleaning blade member in operational position adjacent a surface from which toner is to be removed;

toner transport means for transporting removed toner away from the area about said cleaning blade member.

13. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning housing formed in a unitary extrusion and located adjacent to the charge retentive surface;

cleaning blade means for removing toner from a surface;

toner transport means for transporting removed toner away from the area about said cleaning blade member and including auger for transport of removed toner to an output, supported within an auger recess formed in said cleaning housing for augering motion moving toner through said auger recess to an output, and an auger extrusion liner, removably insertable into said auger recess, and sealing means, integral with said auger extrusion liner, for preventing toner from escaping said auger recess.

14. Apparatus as defined in claim 13 wherein said auger extrusion is provided with at least one seating tab to correctly position said auger extrusion into a complementary seating slot formed in said cleaning housing within said auger recess.

* * * * *